US007271794B1

(12) United States Patent
Cheng et al.

(10) Patent No.: US 7,271,794 B1
(45) Date of Patent: Sep. 18, 2007

(54) POWER SAVING CIRCUIT EMPLOYING VISUAL PERSISTENCE EFFECT FOR BACKLIGHT MODULES

(75) Inventors: Ying-Nan Cheng, Taipei Hsien (TW); Chin-Biau Chung, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 11/543,138

(22) Filed: Oct. 5, 2006

(51) Int. Cl.
*G09G 3/36* (2006.01)

(52) U.S. Cl. ..... 345/102; 345/204; 345/212; 315/312; 315/294; 315/360

(58) Field of Classification Search ..... 315/294, 315/297, 307, 312, 360; 345/94, 102, 204, 345/212

See application file for complete search history.

(56) References Cited

U.S. PATENT DOCUMENTS 6,791,527 B2 * 9/2004 Yoshinaga et al. ..... 345/102
2006/0132413 A1 * 6/2006 Chen et al. ..... 345/94
2006/0187660 A1 * 8/2006 Liu ..... 362/294

FOREIGN PATENT DOCUMENTS

TW 580681 A 3/2004

* cited by examiner

*Primary Examiner*—Haissa Philogene
(74) *Attorney, Agent, or Firm*—Birch, Stewart, Kolasch & Birch, LLP

(57) ABSTRACT

A power saving circuit employing visual persistence effect for backlight modules aims to increase electric power at a duty mode to drive lighting units at a read end through driving units, and provide zero or lower electric power at a power saving mode to the lighting units at the rear end. Different lighting units generate light alternately in a first condition time sequence to enable user's eyes to get images. In a second condition time sequence power consumption of the driving units is reduced and user's eyes still can maintain visual sense of the images due to visual persistence effect, thereby electric power can be saved.

10 Claims, 8 Drawing Sheets

POWER SAVING CIRCUIT EMPLOYING VISUAL PERSISTENCE EFFECT FOR BACKLIGHT MODULES

FIELD OF THE INVENTION

The present invention relates to an alternate driving circuit of backlight modules and particularly to a power saving circuit that adopts visual persistence effect to save electric power for generating light on a backlight module.

BACKGROUND OF THE INVENTION

Liquid crystal display (LCD) that turns images through liquid crystal molecules is widely used on many types of electronic products nowadays. In recent years as the awareness of environmental protection grows, many countries have established power saving regulations to reduce electric power consumption of electric appliances. For large organizations, enterprises or governmental institutions, the accumulating cost of using LCD panels for a prolonged period of time is significant. To address this concern, many types of power saving LCD panels have been developed on the market. For instance, R.O.C. patent publication No. 580681 discloses a power saving LCD which performs display by receiving a multi-level operation voltage. It includes an upper baseboard consisting of an upper electrode and an ½ wave plate, a lower baseboard consisting of a lower electrode and a liquid crystal layer located between the upper electrode and the lower electrode. When the liquid crystal molecules in the liquid crystal layer is in a first stable condition, the multi-level operation voltage controls transmittance of the liquid crystal layer, and the liquid crystal layer is equivalent to ¼ wave plate. A signal generator also is provided to be electrically connected to the upper electrode and the lower electrode to generate a switch signal to the upper electrode and the lower electrode so that the liquid crystal molecules in the liquid crystal layer can be switched from the first stable condition to a second stable condition to give the liquid crystal layer a constant transmittance.

However, the power saving LCD panel mentioned above has a complicated structure and is difficult to fabricate. It also has to use special materials to form the liquid crystal layer. As a result, the cost of the LCD panel is higher. How to provide a simpler power saving structure for LCD panels without increasing the cost too much is a big issue in the industry.

SUMMARY OF THE INVENTION

The primary object of the present invention is to reduce power consumption for lighting of backlight modules by adopting visual persistence effect.

To achieve the foregoing object, the invention provides a power saving circuit for backlight modules that adopts visual persistence effect. It aims to drive alternately a plurality of lighting units located in a backlight module. It includes a time sequence generator to generate a time sequence signal, a logic circuit to receive the time sequence signal from the time sequence generator and generate a plurality of alternate cyclic signals that have first condition time sequence and second condition time sequence, and a plurality of driving units each receives one alternate cyclic signal to drive one lighting unit to generate light. In the first time sequence condition the driving unit increases electric power at a duty mode to supply the lighting unit at a rear end. In the second time sequence condition a power saving mode is adopted to supply zero or lower electric power to the lighting unit at the rear end. Light generated by the lighting unit in the first condition time sequence enables user's eyes to get images. In the second condition time sequence the driving unit consumes less electric power and allows user's eyes to maintain visual sense through visual persistence effect. Thus power saving object can be achieved.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
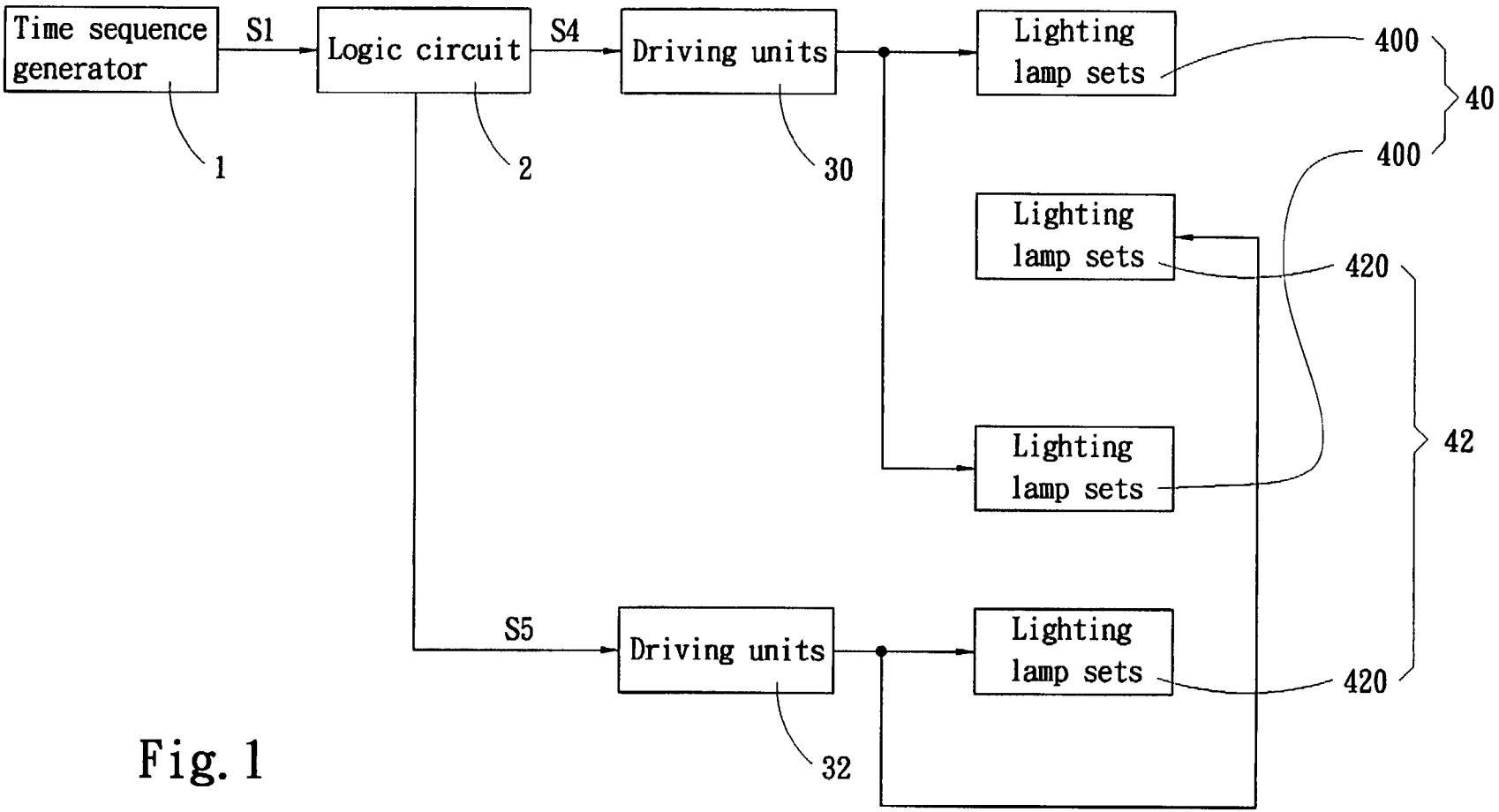
FIG. 1 is a structural block diagram of a first embodiment of the invention.
Figure 2:
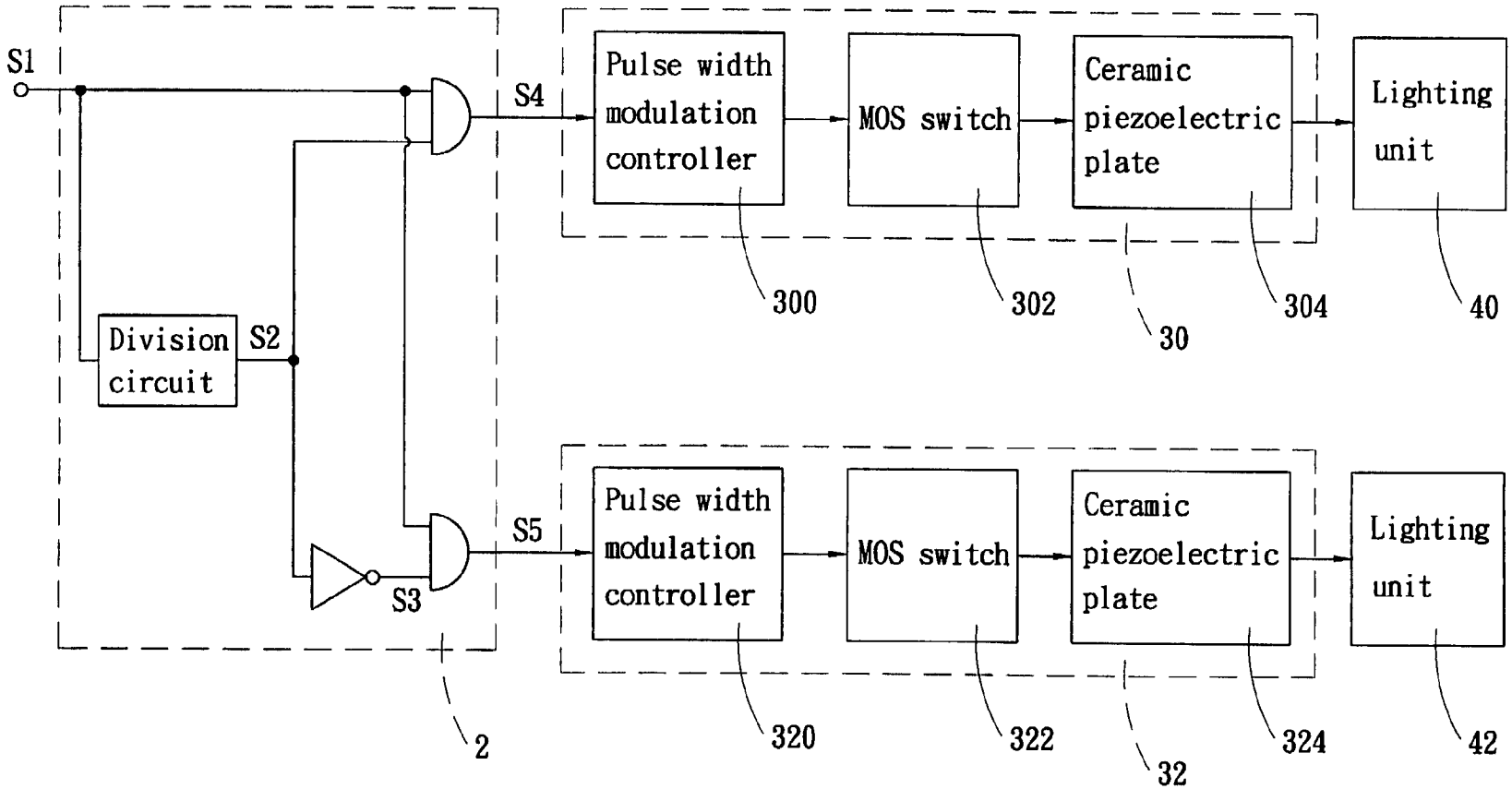
FIG. 2 is a schematic view of the logic circuit and driving unit of the first embodiment of the invention.

Please refer to FIGS. 1 and 2 for a structural block diagram and a schematic view of the logic circuit and driving unit of a first embodiment of the invention. The invention is a power saving circuit for backlight modules that adopts visual persistence effect. This embodiment includes a first lighting unit 40 which has two first lamp sets 400 and a second lighting unit 42 which has two second lamp sets 420. One first lamp set 400 is adjacent to another second lamp set 420. The first and second lighting units 40 and 42 generate light alternately to make luminance more uniform.

Figure 3:
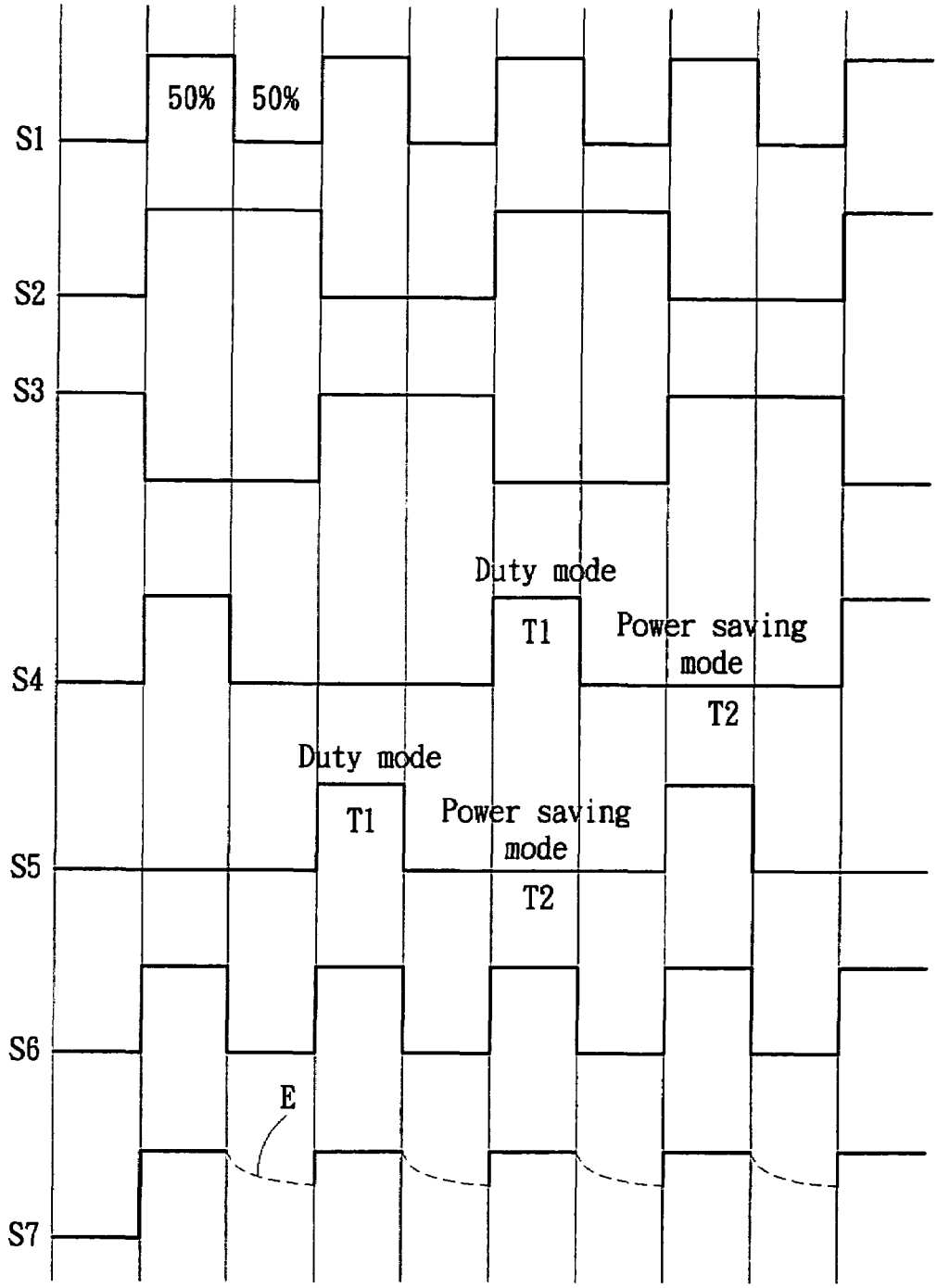
FIG. 3 is a schematic view of waveforms of the first embodiment of the invention.

The invention includes:

a time sequence generator 1 to generate a time sequence signal S1 (referring to FIG. 3). The time sequence signal S1 has a frequency preferably greater than 120 or 240 Hz (hertz) to meet the requirement of visual persistence of human eyes. The time sequence generator 1 may be a pulse width modulation (PWM) controller;

a logic circuit 2 to receive the time sequence signal S1 from the time sequence generator 1 to generate an alternate cyclic signal. In this embodiment, as the backlight module has two lighting units 40 and 42 to generate respectively a first condition time sequence T1 and a second condition time sequence T2, the logic circuit 2 generates only two alternate cyclic signals S4 and S5 (referring to FIG. 3). The first condition time sequence T1 is a high voltage condition time sequence, and the second condition time sequence T2 is a low voltage or zero voltage condition time sequence; and a plurality of driving units 30 and 32 operating in a duty mode and a power saving mode. The driving units 30 and 32 include respectively a PWM controller 300, 320, a MOS switch 302, 322, and a ceramic piezoelectric plate (PZT) 304, 324 to output electric power to the lighting units 40 and 42 at the rear end. The driving units 30 and 32 receive respectively one alternate cyclic signal S4 and S5 to drive respectively one of the lighting units 40 and 42 to generate light. The lighting units 40 and 42 at the rear end are driven to generate light at the duty mode when the alternate cyclic signals S4 and S5 are in the first condition time sequence T1. The lighting units 40 and 42 are driven at the power saving mode when the alternate cyclic signals S4 and S5 are in the second condition time sequence T2, and the lighting conditions of all the lighting units 40 and 42 are coupled to make the entire backlight module to enter a blinking display condition S6 (referring to FIG. 3). Thus the lighting units 40 and 42 in the first time sequence T1 generate light to enable people's eyes to get images. In the second time sequence T2, the lighting units 40 and 42 are driven at the power saving mode. Because of visual persistence effect E (referring to FIG. 3), people's eyes still can maintain visual sense S7. Hence power consumption of the driving units 30 and 32 can be reduced to save electric power.

Figure 4:
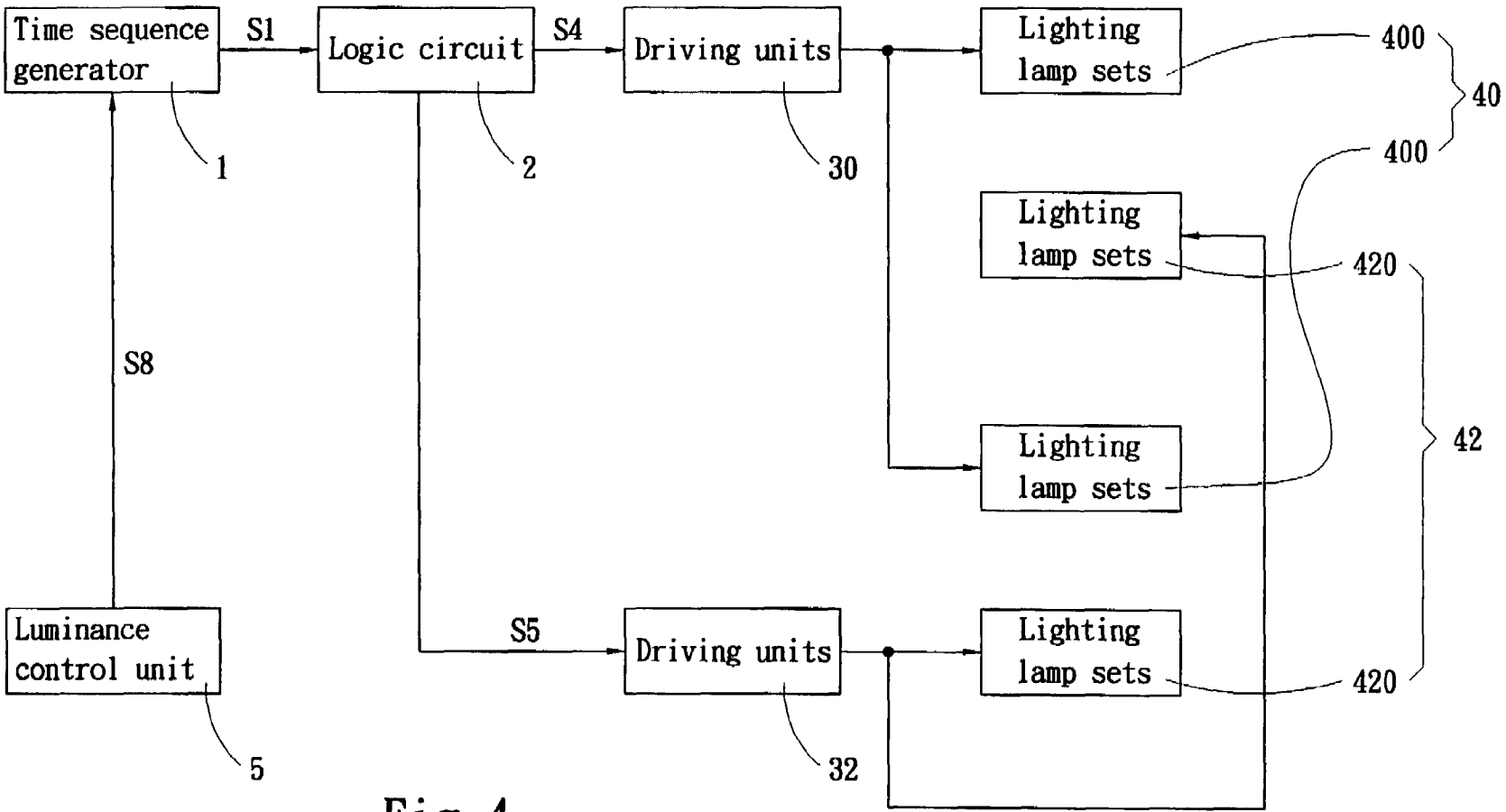
FIG. 4 is a structural block diagram of a second embodiment of the invention.
Figure 5:
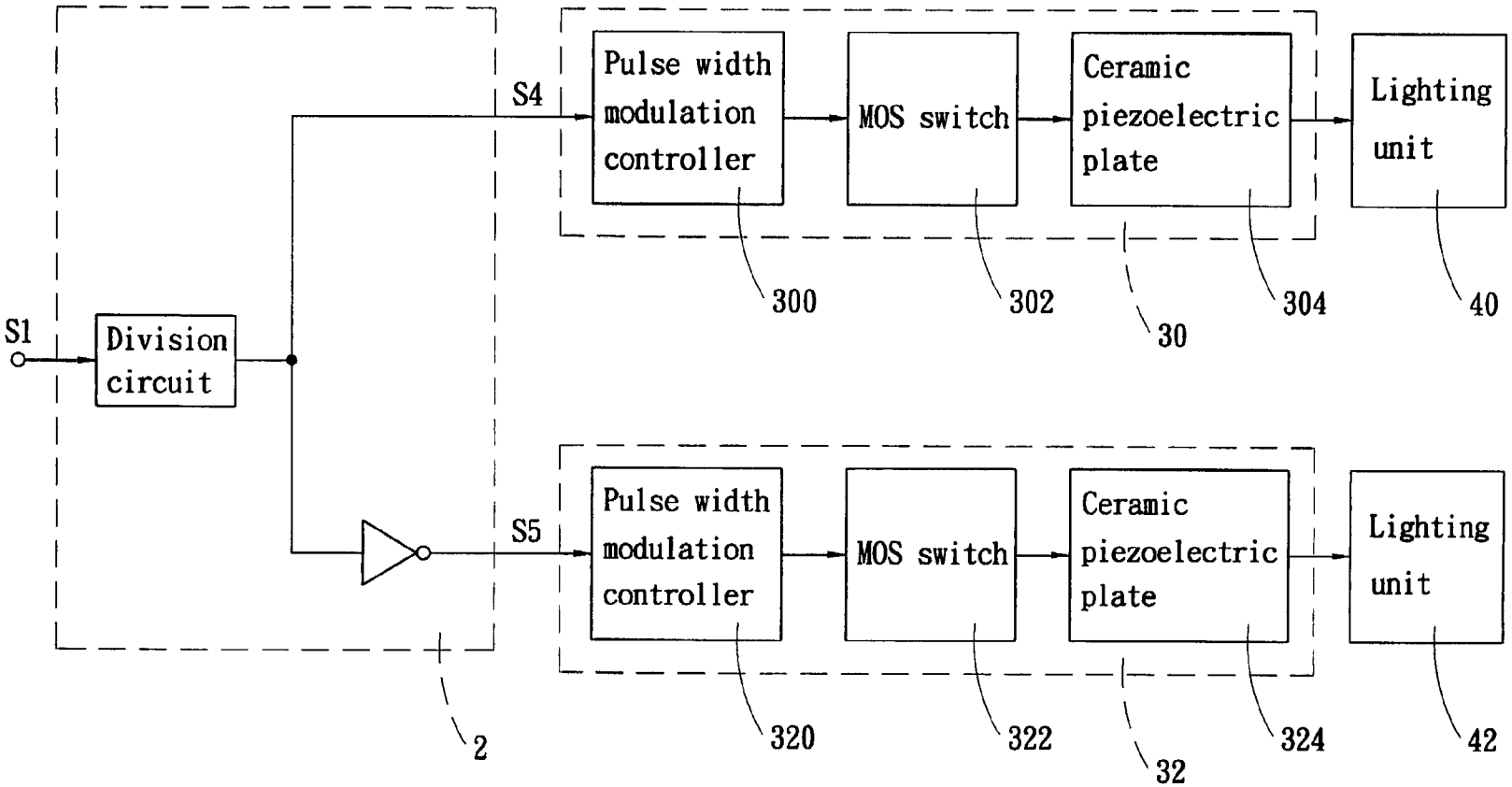
FIG. 5 is a schematic view of the logic circuit and driving unit of the second embodiment of the invention.

Referring to FIGS. 4 and 5 for a second embodiment of the invention. It differs from the first embodiment in two areas:

First, the time sequence generator 1 is electrically connected to a luminance control unit 5 which generates a duty frequency to slice the driving electric power provided by the driving units 30 and 32 to regulate the luminance of the lighting units 40 and 42. The luminance control unit 5 may be a PWM controller to generate a signal S8 (referring to FIG. 6). After slicing by the duty frequency, the first condition time sequence T1 occupies 30% of the total cycle and the second condition time sequence T2 occupies 70% of the total cycle.

Figure 6:
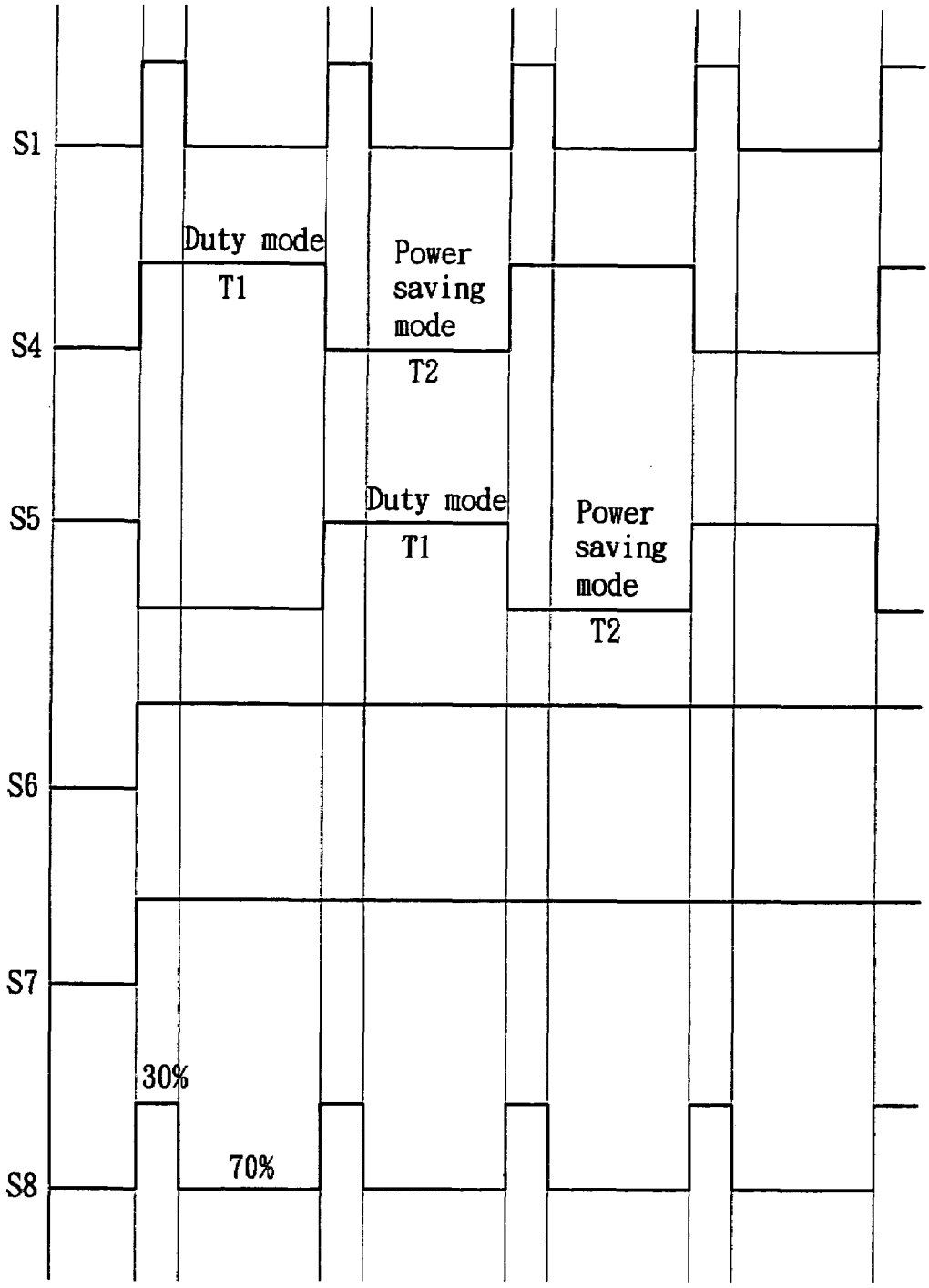
FIG. 6 is a schematic view of waveforms of the second embodiment of the invention.

Second, the logic circuit 2 is simplified and directly generates the alternate cyclic signals S4 and S5 through an inverter (referring to FIG. 6).

The second embodiment thus constructed consumes more electric power than the first embodiment, but theoretically the backlight module can maintain lighting display condition continuously (the actual frequency of the driving units 30 and 32 is about 53 Hz, but still enables human eyes to maintain the visual sense of continuous lighting display due to visual persistence effect). Thus it gives user's eyes improved visual sense S7 (referring to FIG. 6). The cost of the circuit also is lower.

Figure 7:
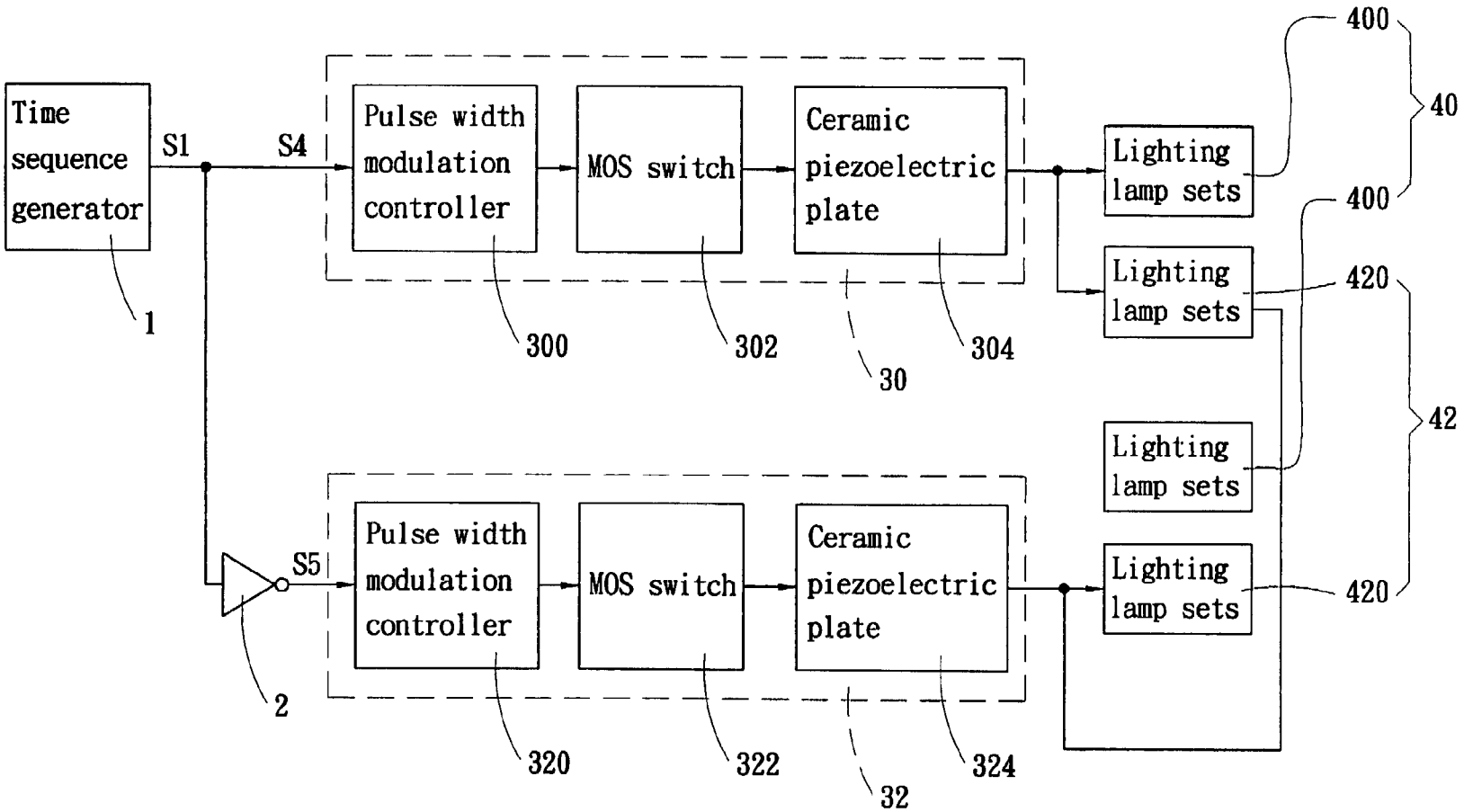
FIG. 7 is a structural block diagram of a third embodiment of the invention.
Figure 8:
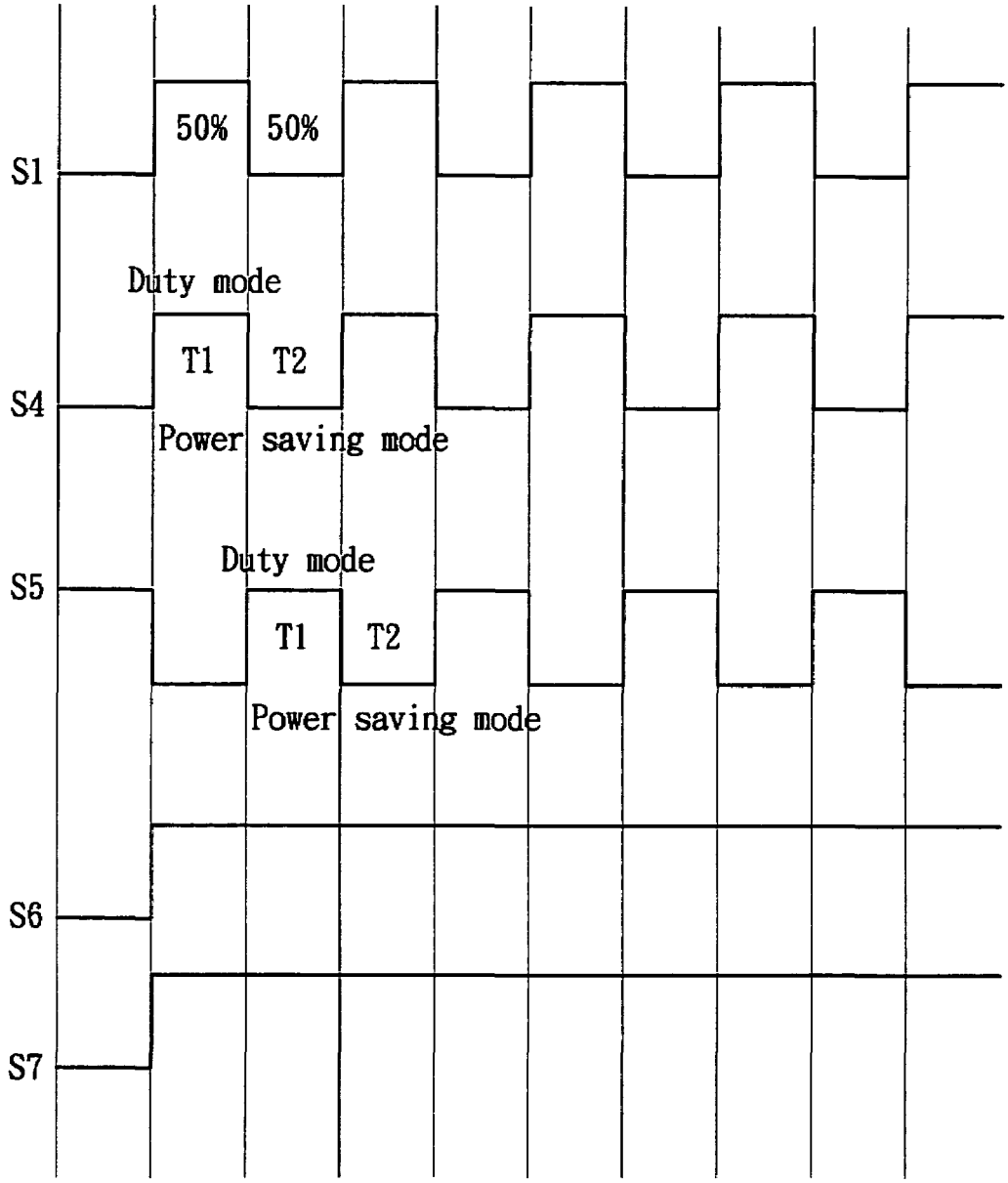
FIG. 8 is a schematic view of waveforms of the third embodiment of the invention.

Refer to FIG. 7 for a third embodiment of the invention. It differs from the first embodiment by making the logic circuit 2 an inverter. Hence the time sequence generator 1 directly generates the two alternate cyclic signals S4 and S5 through the inverter (referring to FIG. 8) for the driving units 30 and 32 to output electric power. Theoretically the third embodiment also enables the entire backlight module to maintain lighting display condition continuously (the actual frequency of the driving units 30 and 32 is about 53 Hz, but still enables human eyes to maintain the visual sense of continuous lighting display due to visual persistence effect). Thus it gives user's eyes improved visual sense S7. Compared with the two previous embodiments, making the alternate cyclic signals S4 and S5 higher than 60 Hz can meet the requirement of visual persistence effect for human eyes. The power saving effect can be achieved at a minimum circuit cost. Theoretically the third embodiment also enables the entire backlight module to maintain lighting display condition continuously.

In short, when the invention is in use, if the first condition time sequence T1 and the second condition time sequence T2 occupy respectively 50% of the total cycle, the driving units 30 and 32, and the lighting units 40 and 42 consume only one half of electric power than continuous lighting. From viewer's perspective, the visual persistence effect of human eyes reduces luminance about 10-30%, hence the actual luminance sensed by the human eyes is about 70%-90% of the continuous lighting, but the power consumption can be reduced to one half of the continuous lighting (as only one half cycle of 100% luminance is in the driving lighting condition). If the luminance generated in the first condition time sequence T1 is increased to 130% of the original value, the actual visual sense of luminance in human eyes due to visual persistence is 100%-120%, while the power consumption can be reduced to 65% of the original continuous lighting (as only one half cycle of 130% luminance is in the driving lighting condition). Thus the invention can save electric power by adopting the visual persistence effect. It provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A power saving circuit employing visual persistence effect for backlight modules to drive alternately a plurality of lighting units located on a backlight module, comprising:

a time sequence generator to output a time sequence signal;

a logic circuit to receive the time sequence signal from the time sequence generator and generate a plurality of alternate cyclic signals that contain a first condition time sequence and a second condition time sequence; and a plurality of driving units which have a duty mode and a power saving mode, each of the driving units receiving one alternate cyclic signal to drive one lighting unit and provide increased electric power for the lighting unit at a rear end at the duty mode in the first condition time sequence and provide zero or reduced electric power for the lighting unit at the rear end at the power saving mode in the second condition time sequence; thereby the lighting unit generating light in the first condition time sequence to allow user's eyes to get images, and power consumption of the driving unit in the second condition time sequence being reduced and the visual sense of the images in the user's eyes still being maintained due to visual persistence effect thereby to save electric power.

2. The power saving circuit of claim 1, wherein the time sequence generator is a pulse width modulation controller.

3. The power saving circuit of claim 1, wherein the logic circuit is an inverter.

4. The power saving circuit of claim 1, wherein the time sequence signal has a frequency greater than one of 60 Hz, 120 Hz and 240 Hz.

5. The power saving circuit of claim 1, wherein each of the lighting units includes a plurality of lighting lamp sets.

6. The power saving circuit of claim 1, wherein the driving unit includes a pulse width modulation controller, a MOS switch and a ceramic piezoelectric plate to output electric power to the lighting units at the rear end.

7. The power saving circuit of claim 1, wherein the time sequence generator is electrically connected to a luminance control unit which generates a duty frequency to slice the driving electric power provided by the driving unit.

8. The power saving circuit of claim 7, wherein the luminance control unit is a pulse width modulation controller.

9. The power saving circuit of claim 1, wherein the first condition time sequence is high voltage condition time sequence, and the second condition time sequence is low voltage condition time sequence.

10. The power saving circuit of claim 1, wherein the first condition time sequence is high voltage condition time sequence, and the second condition time sequence is zero voltage condition time sequence.

* * * * *